US010201738B2

(12) United States Patent
Magrino et al.

(10) Patent No.: US 10,201,738 B2
(45) Date of Patent: Feb. 12, 2019

(54) UNDERWATER STRIKING BAG DEVICE AND METHOD OF USING THE SAME

(71) Applicants: Robert Magrino, Woodinville, WA (US); Bernadette D'Souza, Woodinville, WA (US)

(72) Inventors: Robert Magrino, Woodinville, WA (US); Bernadette D'Souza, Woodinville, WA (US)

( * ) Notice: Subject to any disclaimer, the term of this patent is extended or adjusted under 35 U.S.C. 154(b) by 0 days.

(21) Appl. No.: 15/794,223

(22) Filed: Oct. 26, 2017

(65) Prior Publication Data

US 2018/0050253 A1 Feb. 22, 2018

Related U.S. Application Data

(63) Continuation-in-part of application No. 15/286,607, filed on Oct. 6, 2016, which is a continuation-in-part (Continued)

(51) Int. Cl.
*A63B 21/00* (2006.01)
*A63B 69/20* (2006.01)
(Continued)

(52) U.S. Cl.
CPC ..... *A63B 69/203* (2013.01); *A63B 21/0084* (2013.01); *A63B 23/02* (2013.01); (Continued)

(58) Field of Classification Search
CPC . A63B 69/20–69/325; A63B 2244/102; A63B 2208/03; A63B 2225/60; A63B 21/0084; A63B 67/007; A63B 21/00058; A63B 21/00069; A63B 21/008; A63B 21/0085; A63B 21/0088; A63B 21/0601; A63B 21/0602; A63B 21/0606; A63B 21/4033; A63B 21/4035; A63B 69/345; A63B 71/0054; A63B 71/02; A63B 71/023; A63B 2071/0063; A63B 2071/0072; (Continued)

(56) References Cited

U.S. PATENT DOCUMENTS 1,890,696 A 12/1932 Rosenhahn
2,186,403 A 1/1940 Bullis
(Continued)

FOREIGN PATENT DOCUMENTS

WO WO2012001536 1/2012

OTHER PUBLICATIONS

Getty Images Man Boxing in Pool www.gettyimages.com/detail/photo/man-boxing-in-pool-with-punch-bag-high-res-stock-photography/200520483-001 Nov. 27, 2015.

*Primary Examiner* — Gary D Urbiel Goldner
(74) *Attorney, Agent, or Firm* — R. William Graham

(57) ABSTRACT

An underwater striking bag device includes a bag having an annular upper compartment disposed in an upper section of the bag and receiving air therein, a neck extending through the upper section and communicating with a lower compartment receiving water therein, a removable cap connected to the neck, an air valve connected to the annular upper compartment to provide for filling air into the annular upper compartment, at least one handle connected to the bag for assisting in filling and removal of the water into the lower compartment.

12 Claims, 10 Drawing Sheets

Related U.S. Application Data of application No. 15/004,927, filed on Jan. 23, 2016, now abandoned.

(51) Int. Cl.

| | |
|---|---|
| ***A63B 71/02*** | (2006.01) |
| ***A63B 21/008*** | (2006.01) |
| ***A63B 23/02*** | (2006.01) |
| ***A63B 23/035*** | (2006.01) |
| *A63B 71/06* | (2006.01) |

(52) U.S. Cl.

CPC ..... *A63B 23/03575* (2013.01); *A63B 69/20* (2013.01); *A63B 69/208* (2013.01); *A63B 21/4013* (2015.10); *A63B 21/4021* (2015.10); *A63B 2071/026* (2013.01); *A63B 2071/0694* (2013.01); *A63B 2208/03* (2013.01); *A63B 2225/093* (2013.01); *A63B 2225/605* (2013.01)

(58) Field of Classification Search

CPC ..... A63B 2071/009; A63B 2071/026; A63B 2208/05; A63B 2208/053; A63B 2225/09; A63B 2225/093; A63B 2225/605; A63B 2225/62; A63B 2244/10; A63B 2244/104; A63B 2244/106; A63B 2244/108

USPC ..... 482/83–90

See application file for complete search history.

(56) References Cited

U.S. PATENT DOCUMENTS

| | | | | | |
|---|---|---|---|---|---|
| 3,069,162 | A | | 8/1960 | Samuel | |
| 4,103,889 | A | * | 8/1978 | Lobur | A63B 69/201 273/DIG. 20 |
| 4,527,796 | A | | 7/1985 | Critelli | |
| 4,557,478 | A | | 12/1985 | Levine | |
| 4,787,875 | A | | 11/1988 | Baron | |
| 4,822,031 | A | | 4/1989 | Olschewski | |
| 5,330,403 | A | * | 7/1994 | Kuo | A63B 69/208 482/83 |
| 6,080,089 | A | | 6/2000 | Nicholson | |
| 6,106,443 | A | * | 8/2000 | Kuo | A63B 69/34 482/83 |
| 6,558,298 | B2 | * | 5/2003 | Fields | A63B 69/201 482/86 |
| 6,827,674 | B1 | * | 12/2004 | Ferry | A63B 69/201 482/83 |
| 6,994,658 | B2 | * | 2/2006 | Laudenslager | A63B 69/201 482/83 |
| 7,335,136 | B2 | | 2/2008 | Brodbeck | |
| 7,344,482 | B2 | | 3/2008 | Checketts | |
| 7,704,194 | B1 | * | 4/2010 | Chen | A63B 69/208 482/83 |
| 7,758,476 | B2 | * | 7/2010 | Chu | A63B 69/004 482/83 |
| 9,737,780 | B1 | * | 8/2017 | Khunkhun | A63B 69/201 |
| 2002/0086776 | A1 | * | 7/2002 | Fields | A63B 69/201 482/83 |
| 2002/0115538 | A1 | * | 8/2002 | Wen | A63B 69/34 482/83 |
| 2004/0110607 | A1 | | 6/2004 | Crespo | |
| 2005/0159275 | A1 | | 7/2005 | Bullman et al. | |
| 2006/0025285 | A1 | | 2/2006 | Giusti | |
| 2007/0099772 | A1 | * | 5/2007 | Fu | A63B 69/004 482/83 |
| 2008/0125293 | A1 | | 5/2008 | Ng | |
| 2011/0223826 | A1 | | 9/2011 | Gibson | |
| 2011/0312433 | A1 | * | 12/2011 | Parenti | A63B 39/04 473/280 |
| 2012/0157269 | A1 | | 6/2012 | Fu | |
| 2013/0123084 | A1 | | 5/2013 | Miklosi et al. | |
| 2014/0031180 | A1 | | 1/2014 | Jones | |
| 2014/0066268 | A1 | * | 3/2014 | Hafeken, Sr. | A63B 69/20 482/85 |
| 2014/0226919 | A1 | * | 8/2014 | Fu | A63B 69/20 383/3 |
| 2014/0336014 | A1 | | 11/2014 | Francis | |
| 2015/0057132 | A1 | | 2/2015 | Pedone | |
| 2015/0080194 | A1 | * | 3/2015 | Lin | A63B 69/208 482/86 |
| 2015/0273306 | A1 | * | 10/2015 | Fu | A63B 69/201 482/87 |
| 2026/0039502 | | | 2/2016 | Pajonk-Taylor | |
| 2017/0209761 | A1 | * | 7/2017 | Magrino | A63B 69/208 |

* cited by examiner

UNDERWATER STRIKING BAG DEVICE AND METHOD OF USING THE SAME

This is a continuation-in-part of U.S. application Ser. No. 15/286,607 filed Oct. 6, 2016 which is a continuation-in-part of U.S. application Ser. No. 15/004,927 filed Jan. 23, 2016 and claims the benefit thereof.

BACKGROUND OF THE INVENTION

Field of the Invention

The invention generally relates to underwater exercise. More particularly, but not by way of limitation, to an underwater striking bag device and method of using the same.

Prior Art

It is common knowledge that aquatic exercise is beneficial for conditioning and for strengthening muscles. Water resistance provides a low-impact workout to increase cardiovascular fitness and muscle strength without excessive stress on the body. There are devices on the market for exercising in water; many. of them are weights, fins, and resistance devices which are held in the hand or placed over the hands and feet, and then water resistance provides the exerciser additional resistance for conditioning.

Many of these exercise devices are designed to work only one area of a user's body, such as the legs or the arms. Water exercise devices such as water hoops, water volleyball, underwater rugby, and underwater soccer are typically games played with multiple players and while helpful in providing some exercise, they are not directed at providing an optimal workout for the player. One prior underwater ball used a hollow cavity PVC material for holding both water and air pressure without rupturing. The cavity is partially filled with water volume and air pressure to provide a neutral buoyant and pneumatic underwater play ball that can naturally glide under water in a straight line and repeatedly rebound on impact to its original position by itself when passed and bounced underwater for amusement and limited use in exercise. Other types of balls use only slightly negative buoyancy, their movement under water is limited to rolling on the pool bottom. Other underwater non buoyant balls cannot rebound on impact to their original position naturally by their self when passed, kicked or bounced.

Punching and kicking bags are increasing in popularity for fitness and training. These devices are commonly floor based, and their stability is based on the weight or framework holding the device to ceiling or support surface. In such systems, the devices are heavy and difficult to move around. In addition, improper use of punching and kicking bags can lead to injuries of the hands, feet, muscles and connective tissue. To safely use a punching bag, the exerciser should wear protective apparel (e.g. gloves and footwear) to prevent injuries. As such, there is a need for an aquatic exercise device for sports and fitness that minimizes the risk of injury, and that provides an overall cardiovascular workout as well as strengthening of the upper, lower, and core muscle groups and increasing the exerciser's coordination. Furthermore, it would be desirable that the device is compact and lightweight, is easy to assemble and disassemble, and is easily transportable. Still further, it would be desirable to have an exercise device that could be used individually or in groups. The invention is an improvement in the field of exercising and overcomes some of the deficiencies with prior aquatic fitness devices.

SUMMARY OF THE INVENTION

It is an object to provide a method of exercising.

Another object of the invention is to provide an underwater exercise bag device.

Yet another object of the invention is to provide a low impact form of exercise that lessens the chance of injury Still another object is to provide a method of exercising using an underwater punching/kicking bag device for physical fitness.

Still it is the object of this invention to provide a simple exercising device that provides an exercise workout for the arms, legs, and core area.

A still further object of the invention is to provide a light-weight easily transportable exercise device.

Another object of this invention is to provide an exercise device that can be used by persons of any size who are capable of standing in a pool or shallow body of water.

A still further object of this invention is drawn to a method of achieving total body fitness workout by using the exercise device according to this invention.

Accordingly, the invention is directed to an underwater punching bag device and method of exercising using the same. This invention includes an underwater striking bag device, which includes a bag having a bottom section, a mid section, an upper section, an annular upper compartment disposed in an upper section of the bag and receiving air therein and the upper compartment not extending into the mid and lower sections, a neck extending through the upper section and communicating with a lower compartment in the mid section below the upper compartment, the lower compartment receiving water therein, a removable cap connected to the neck, an air valve connected to the annular upper compartment to provide for filling air into the upper compartment, at least one handle connected to the bag for assisting in filling and removal of water into the lower water compartment.

The bag includes bottom section removably receiving a weight, such as a padded weight, within a closable flap of the bottom section. The neck can preferably be a threaded open neck and having a removable cap which is complementary threaded.

The bag includes handles that are located on the upper section and the bottom section. A single handle is located on the bottom section, and two handles are adjacent to the water inlet on the top.

DETAILED DESCRIPTION

Figure 1:
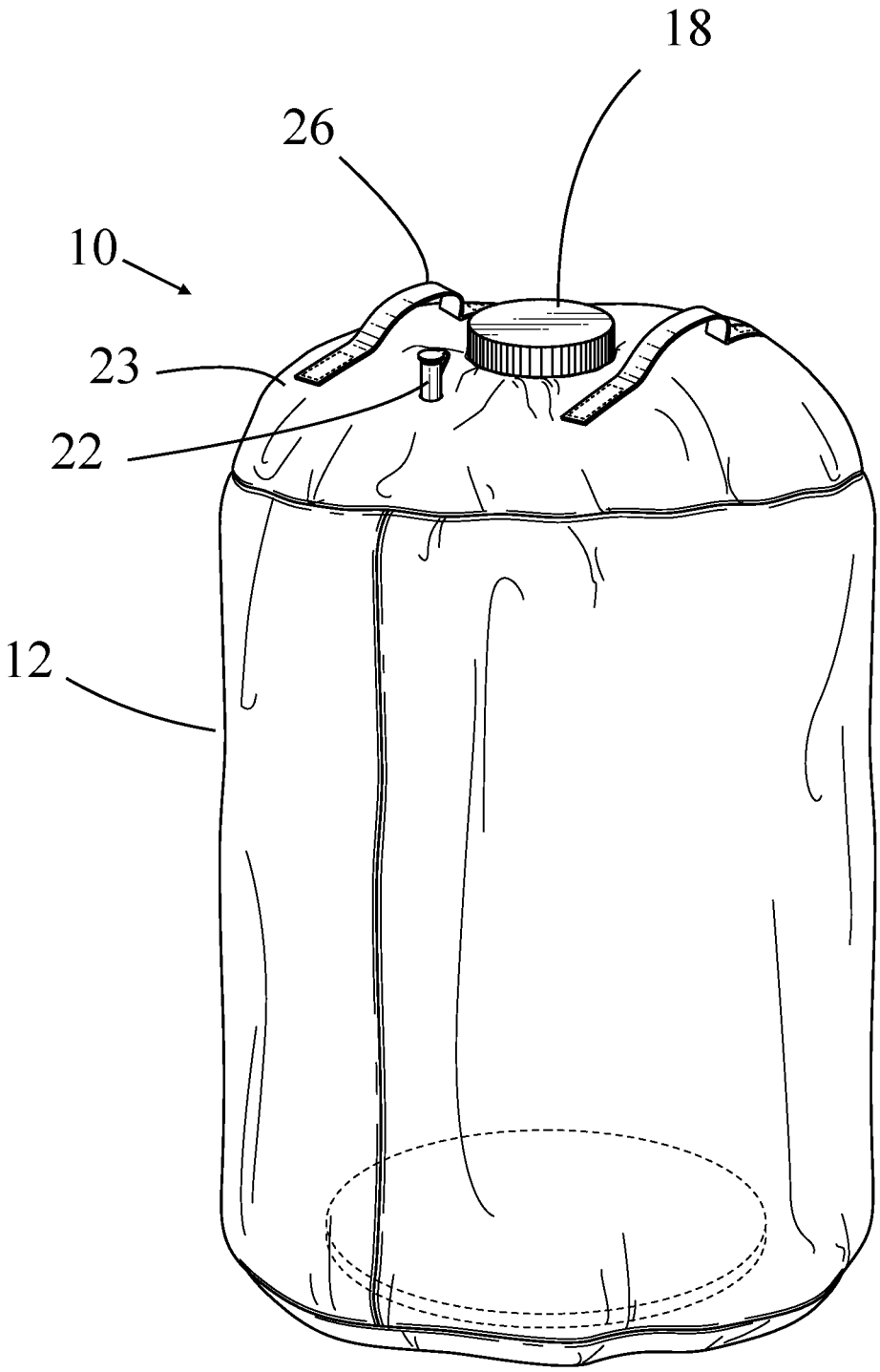
FIG. 1 is a perspective illustration of the invention.
Figure 2:
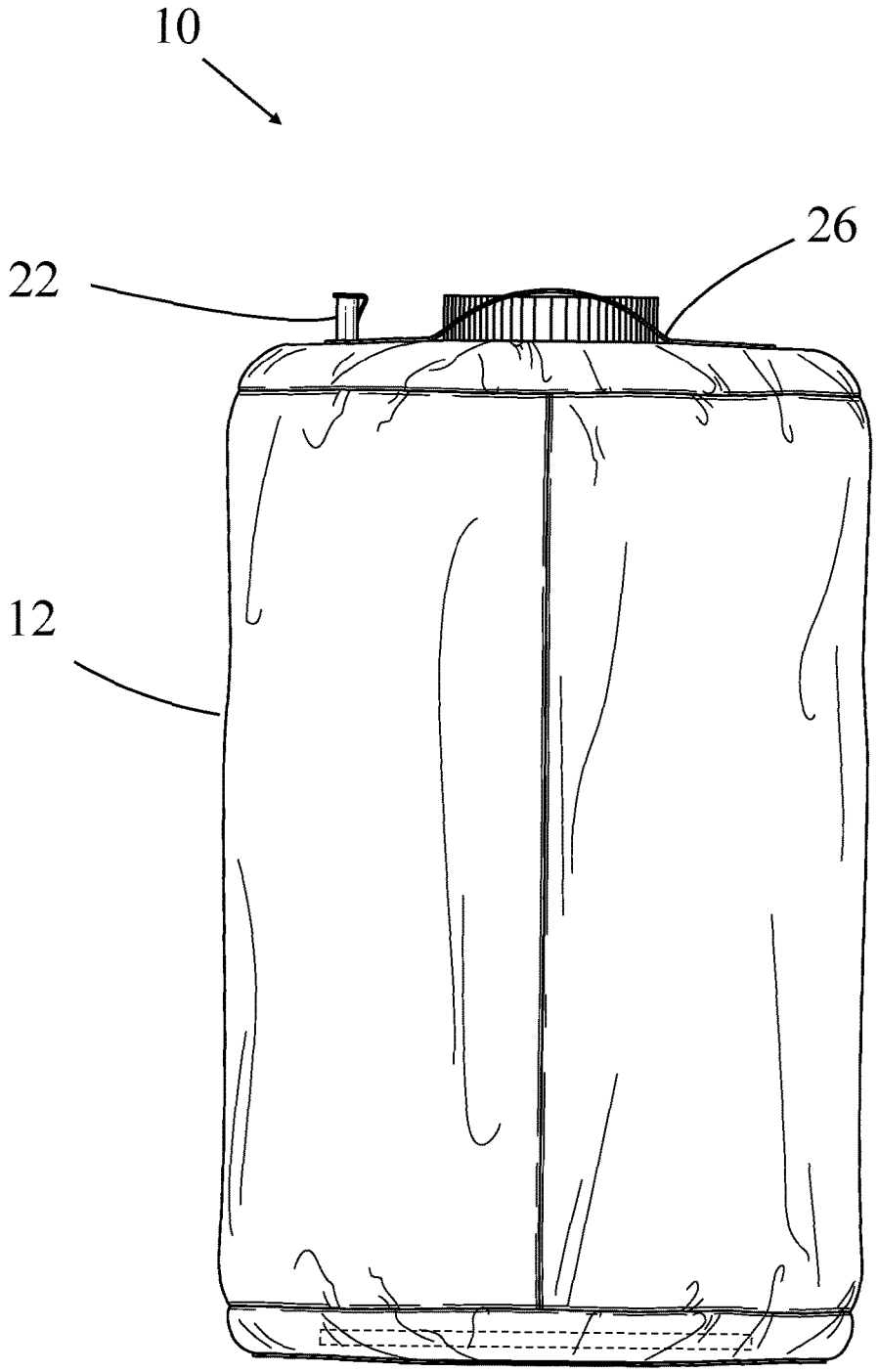
FIG. 2 is a right side illustration of the embodiment of FIG. 1.
Figure 3:
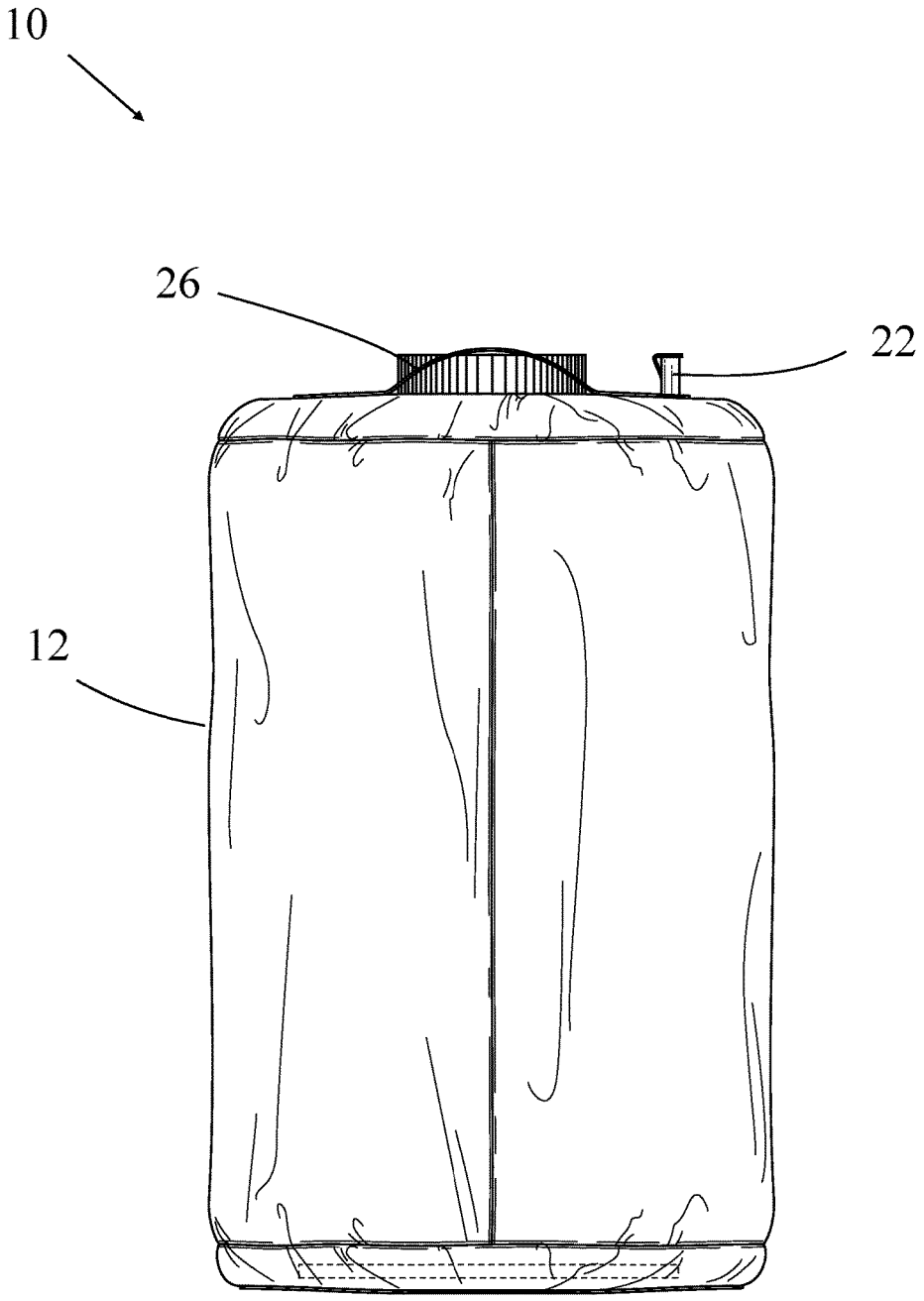
FIG. 3 is a left side illustration of the embodiment of FIG. 1.
Figure 4:
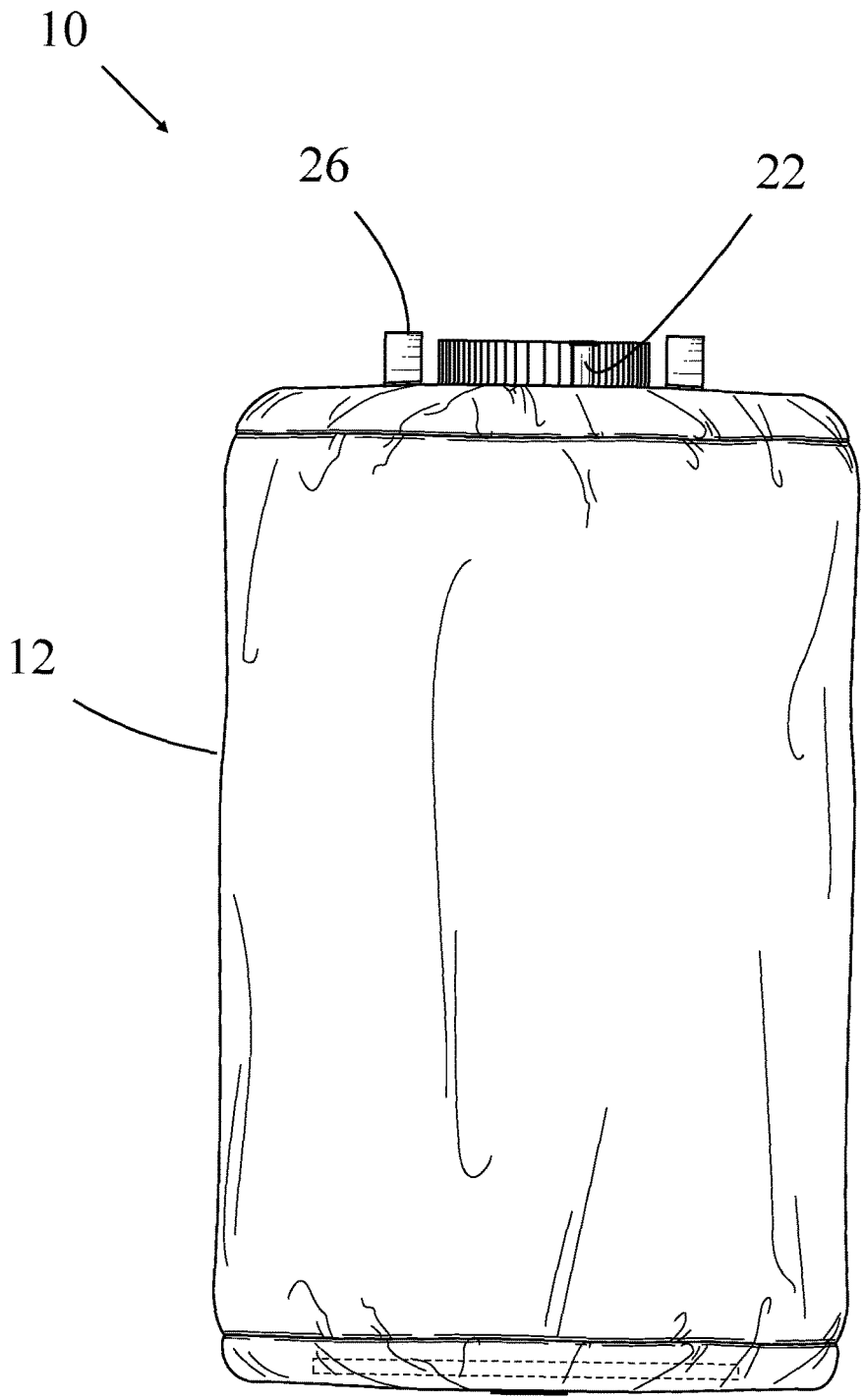
FIG. 4 is a front side illustration of the embodiment of FIG. 1.
Figure 5:
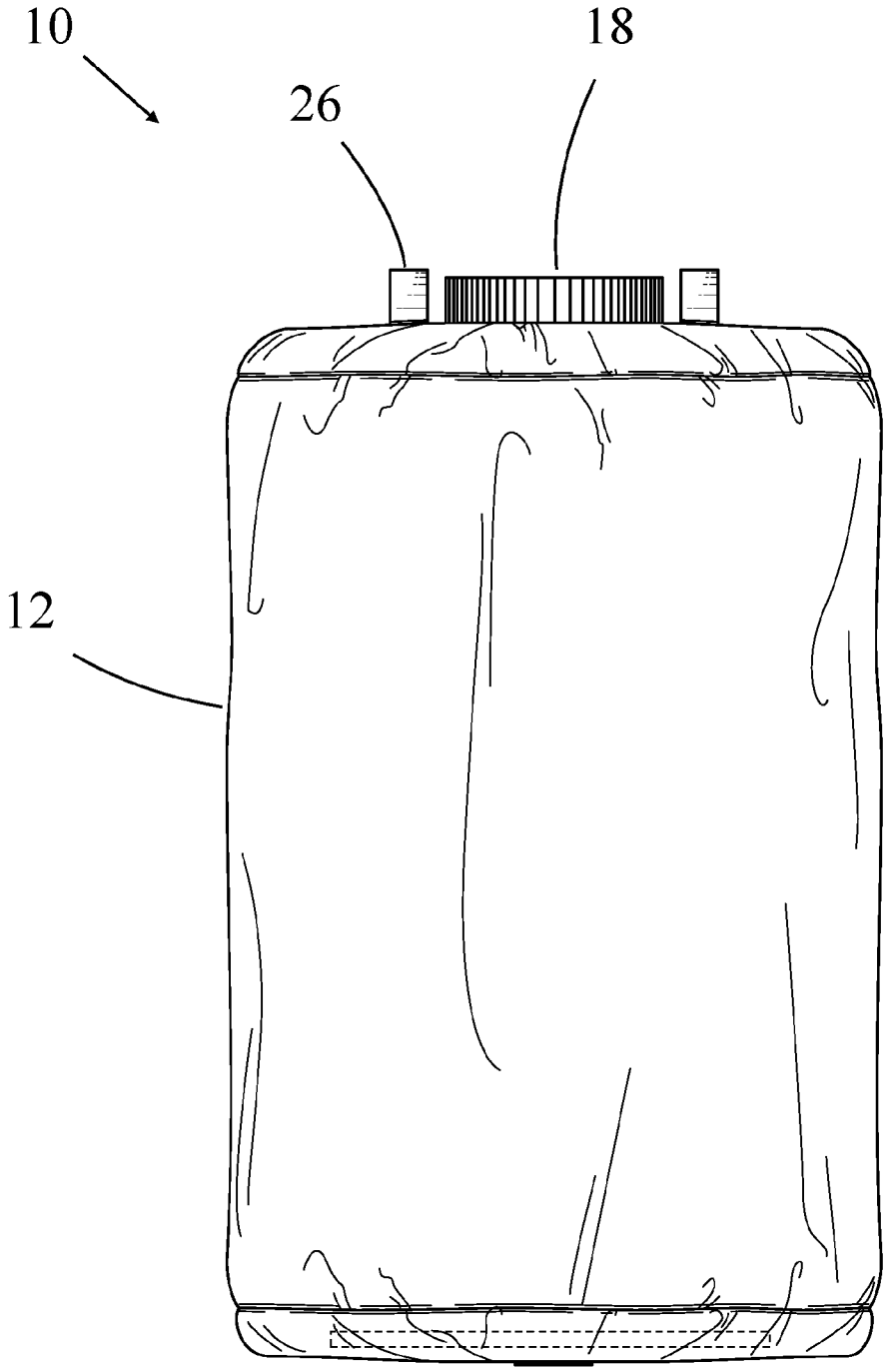
FIG. 5 is a back side illustration of the embodiment of FIG. 1.
Figure 6:
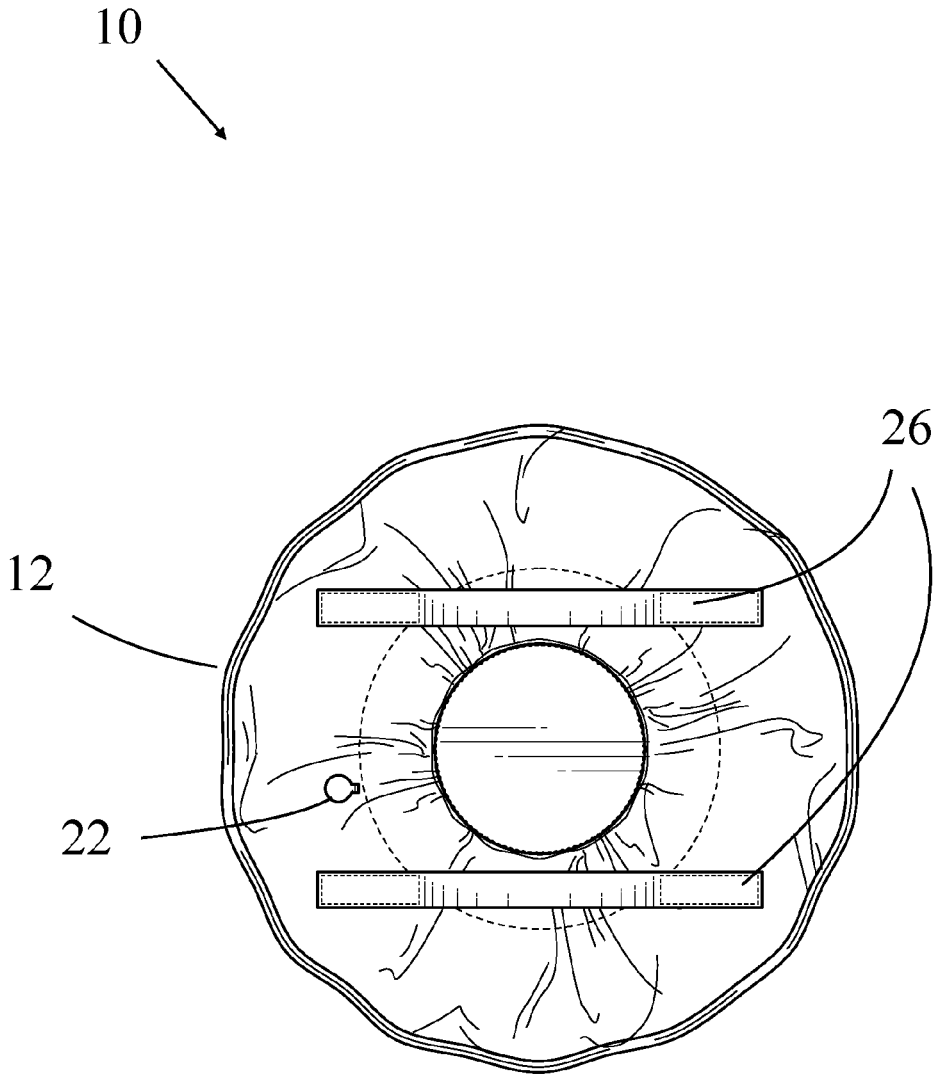
FIG. 6 is a top side view of the embodiment of FIG. 1.
Figure 7:
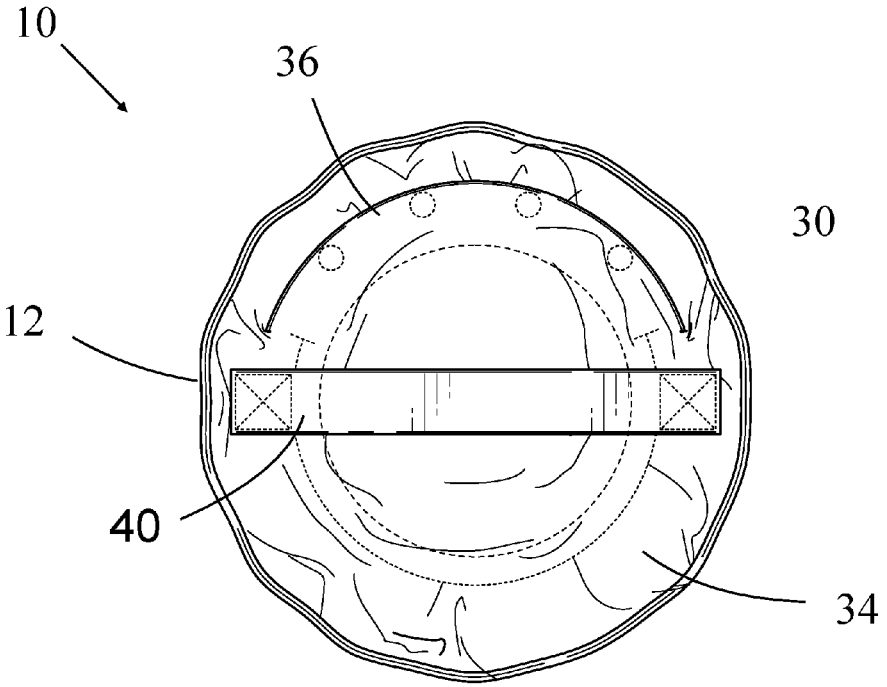
FIG. 7 is bottom side view of the embodiment of FIG. 1 illustrating a closed position.
Figure 8:
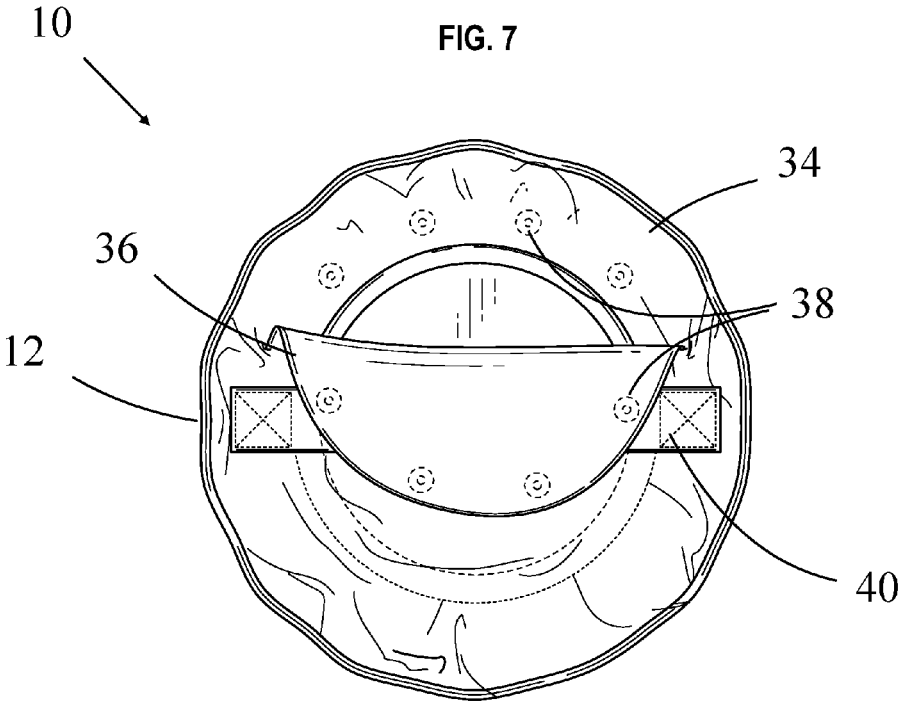
FIG. 8 is a bottom side view of the embodiment of FIG. 1 illustrating an open position.
Figure 9:
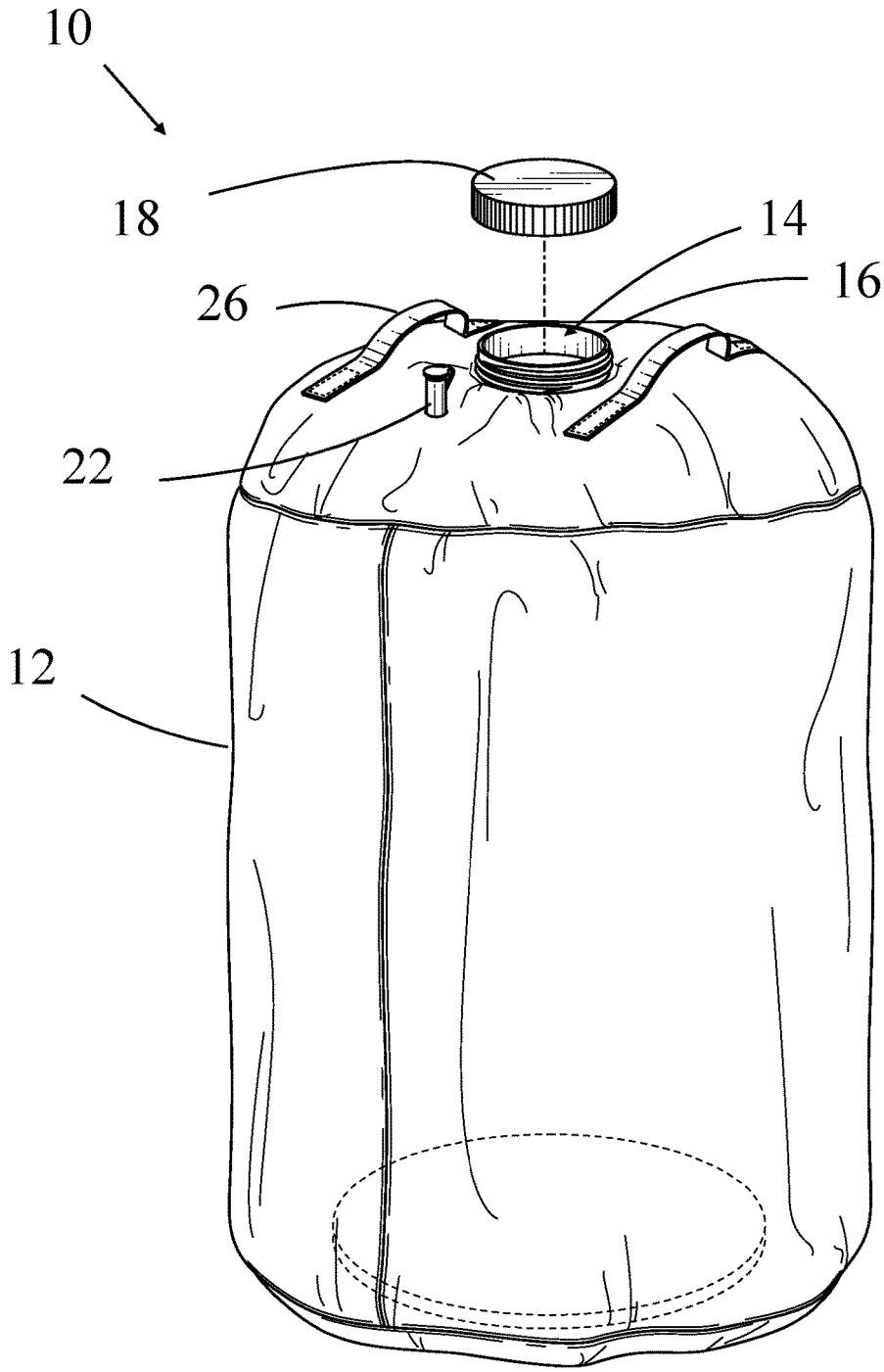
FIG. 9 is a perspective view of the embodiment of FIG. 1 showing a top removed.
Figure 10:
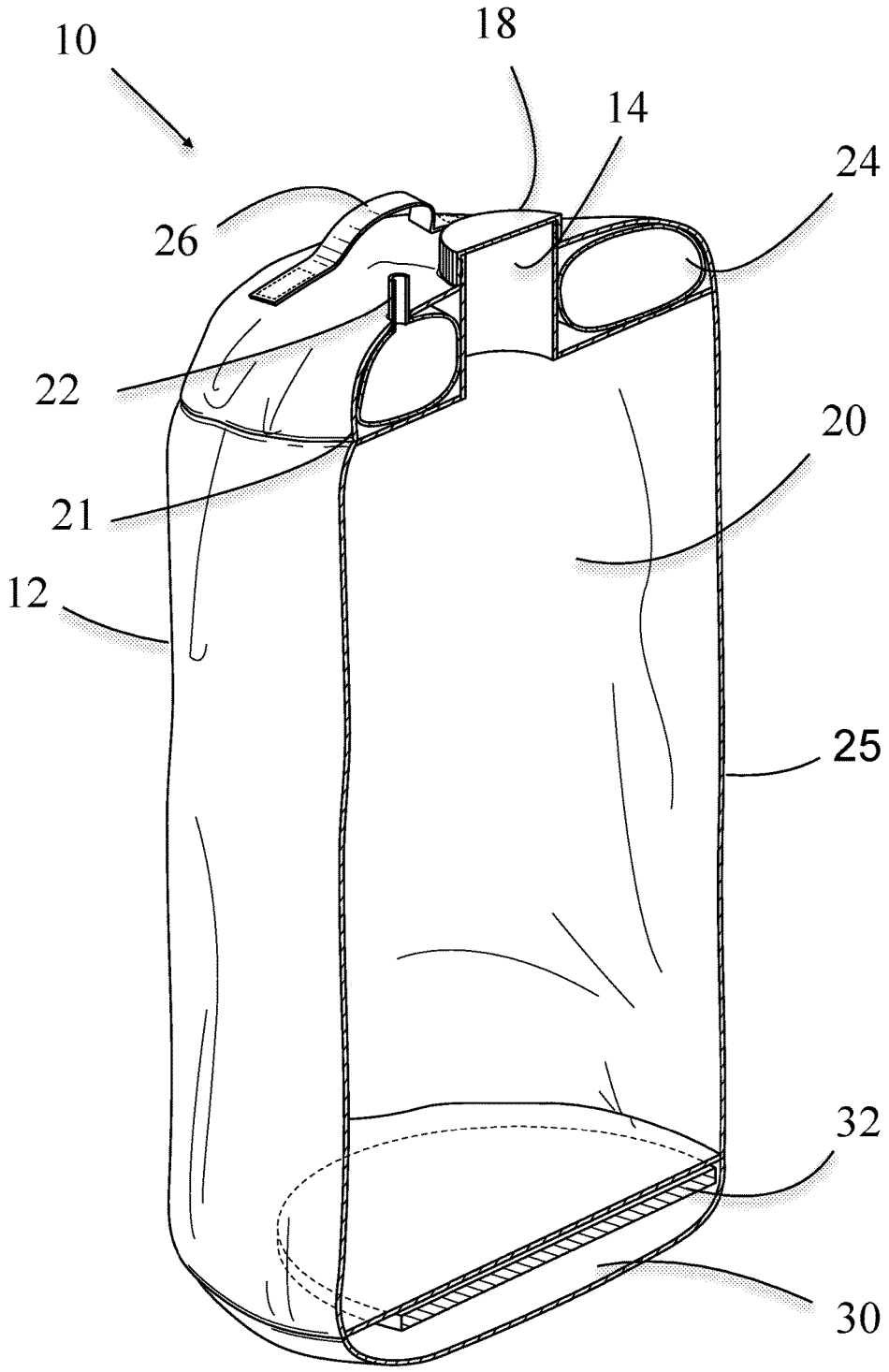
FIG. 10 is a cut-away perspective revealing internal components of the invention.
Figure 11:
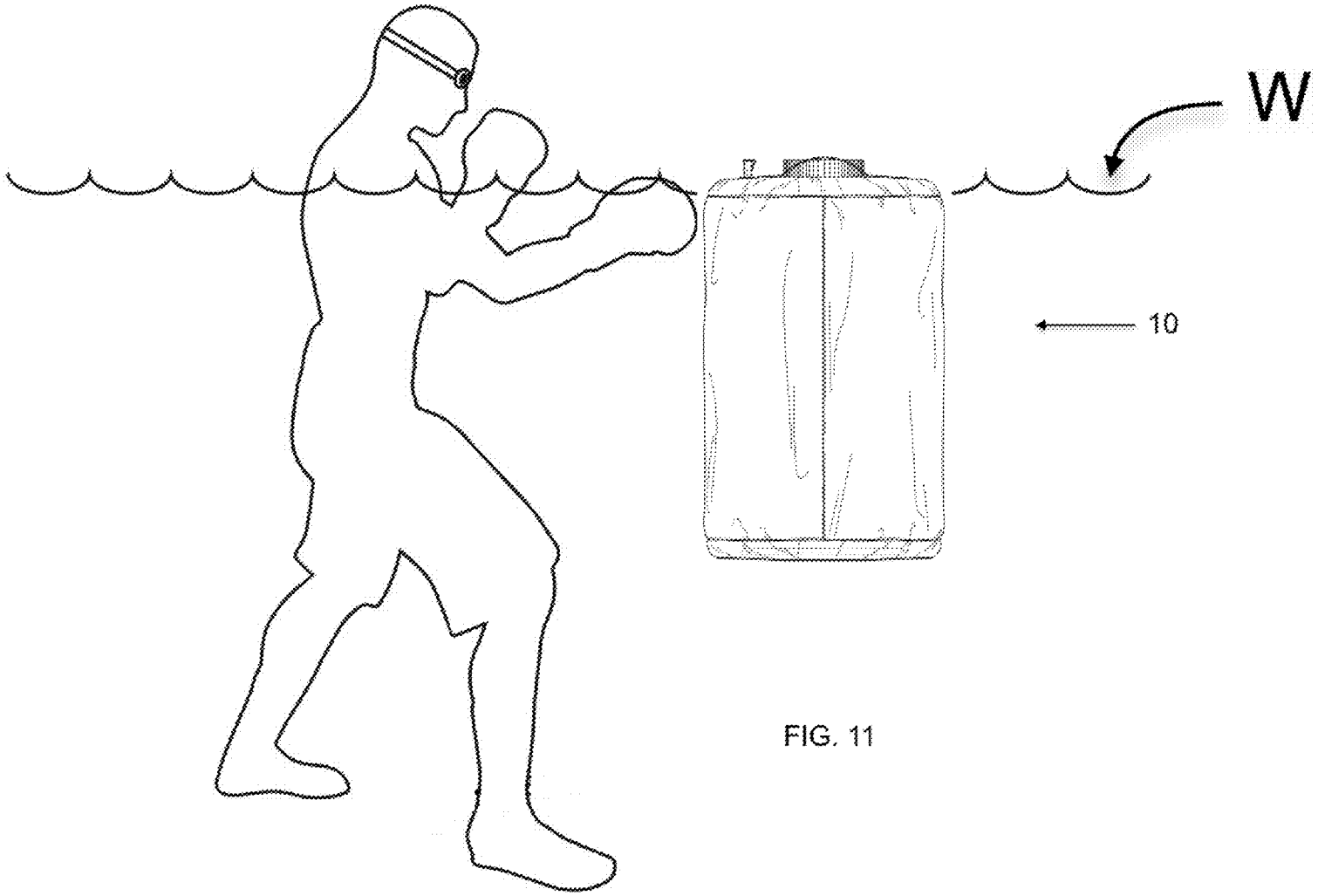
FIG. 11 depicts the invention in use.

Referring now to the figures, the underwater punching bag device of the present invention is represented generally by the numerals 10. The underwater punching bag device 10 includes a bag 12 having a bottom section 30, a mid section 25, an upper section 21, an exterior surface which includes a flexible water impermeable material, such as plastic, having a reclosable open surface 14, such as a threaded open neck 16 (e.g., large port for filling said bag with water) and complementarily threaded cap 18 thereon to permit filling of the bag 12, with water in a lower water compartment 20 of mid section 25. Also, an air valve 22 can be provided to provide for filling of the bag 12 with air into an upper area or annular compartment 24 of upper section 21. The annular compartment 24 is disposed on the upper section 21 and does not extend into the mid section 25 and bottom section 30. It is contemplated that the air valve 22 can be separate as depicted in the embodiment or included as part of the cap 18 while still supplying air to the upper annular compartment 24.

On a top surface 23 of the upper section 21 are a pair of handles 26 which can be a fabric material and stitched or otherwise connected to the top surface 23. The neck 16 extends centrally through the top surface 23 and the upper compartment 24 which is annularly disposed about the neck 16.

The bag 12 can be soft flexible rubber/neoprene material, for example, and can be a generally cylindrical or other shape, container capable to holding a combination of air and water to make it buoyant, based on the amount of air pressure in upper annular compartment 24 with water being in the lower water compartment 20. Less air makes the upper annular compartment 24 affect buoyancy and stiffness of the bag 12 when the lower water compartment 20 is filled with water. By varying the amount of air (increasing/decreasing air pressure) in area/compartment 24, this will keep the bag 12, rigid and buoyant or flaccid and submersible.

In this regard, the lower water compartment 20 is easily filled by removing the cap 18 submerging the bag 12 and by holding the handles 26 and pulling the bag 12 through water to achieve desired water level therein. Then, the cap 18 can be replaced. An alternative method of filling the water compartment 20 is to place the neck 16 over a pool recirculation jet and hold it in place until it is filled with water.

The bottom section 30 of the bag 12 is provided to removably receive a weight 32, which preferably can be a padded weight such as a 5 lb weight. The weight can be a padded element or include a sand bag. An outside surface 34 can be provided with a closable flap 36 which fastens to the outer surface by way of snaps 38, for example, or other closure system such as a zipper or Velcro (not shown), and opens/closes to permit insertion/removal of the weight 32. A handle strap 40 is provided seen as connected to the outside surface 34 and assists in expanding the bag 12 once submerged for filling and to assist in removal and drainage of the bag 12 from the water W.

As mentioned, the bag 12 is height adjustable. Height of the bag 12 can be adjusted based on the amount of air in the upper compartment 24, water in the lower water compartment 20, and/or the weight 32. As air is added/removed, the bag 12 maintains its equilibrium with the surrounding water and keeps the lower water compartment 20 suspended underwater, making it easy to strike or kick.

With the configuration of the punching bag 10, the air compartment 24 is contained in upper section 21, and the water is contained in lower compartment 20 providing increased stability improvement. The use of a weight 32 is optional for larger bags. The air compartment 24 disposed in the manner shown and with the upward air pressure combined with the upward buoyant force of the filled lower water compartment 20, increased stability is provided so the bag 12 returns to the upright position when it is struck or when the bag 12 is tilted sideways. The weight 32 provides better overall stability by creating a lower center of gravity and is far superior, but it is recognized by the inventor that in cases where the compartment 20 is very large the weight 32 may become optional.

Once assembled and the bag 12 is filled as described above, and disposed at a level beneath the water surface W at a desired level, the underwater punching bag device 10, is ready for use. The user may strike the bag 12 with an appendage, such as hands and legs. Meanwhile, the user is fighting the resistant forces of water on moving body parts as well as moving the bag 12. It is noted that the buoyancy can be changed by the amount of water and air in the bag 12 and thus affect the ease of movement of the bag 12 through the water after it is struck. Persons of various sizes may use the device 10.

The present invention is an underwater punching bag device 10 and method of using the same that allows an exerciser a low impact boxing or limited MMA workouts, for example, through the use of water resistance. The air/water/weight combination provides buoyancy and stability to the bag 12 as it is punched and kicked. The exerciser strikes the bag 12 by punching or kicking the bag through the water. By striking the bag 12 through water, water resistance slows the impact, allowing the exerciser to throw punches and kicks with less stress on muscles thereby minimizing injury and allowing improved conditioning of the upper and lower body and the core. Because the bag 12 is filled with water, and the wall is composed of a flexible surface, the impact of hands and feet against the side wall is cushioned by water, lessening the chance of injury.

The exerciser would place the device 10 in a pool or body of water, fill the punching bag 12 with a combination of air, water, and a weight to adjust the buoyancy of the bag 12. The exerciser strikes the bag 12 by punching through the water to hit the bag 12. The exerciser may also step around the bag 12 and strike from different directions, much like a boxer would move around a boxing ring. The exerciser can also push and pull the bag 12 through the water as well as partially lift the bag 12 out of the water to strengthen arm, leg, and core muscles.

The present invention is unique due to the way the device offers a different method of exercise than conventional punching bags or water therapy devices. The present invention device provides a new form of exercise that can be deployed in nearly any swimming pool or body of water and it provides a unique form of low-impact exercise. It is easy to setup and move. It can be used by adults and children. The device 10 can be used for exercise or rehabilitation. Protective gear (gloves) is not required.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of elements can vary.

Therefore, the scope of the invention should be determined by the appended claims and their legal equivalents, not by the examples given.

What is claimed is:

1. An underwater striking bag device comprising: an underwater striking bag having a bottom section, a mid section, an upper section, an annular upper compartment disposed in said upper section and receiving air therein and said annular upper compartment not extending into said mid section and said bottom section, a neck extending through said upper section and communicating with a lower compartment in said mid section below said annular upper compartment, said lower compartment receiving water therein, a removable cap connected to said neck, an air valve connected to said annular upper compartment to provide for filling air into said annular upper compartment, and at least one handle connected to said underwater striking bag for assisting in filling and removal of said water into said lower compartment.

2. The underwater striking bag device of claim 1, wherein said underwater striking bag is made of a flexible water impermeable material.

3. The underwater striking bag device of claim 1, wherein said bottom section removably receives a weight.

4. The underwater striking bag device of claim 3, wherein said weight is a padded weight.

5. The underwater striking bag device of claim 3, wherein said bottom section includes a closable flap.

6. The underwater striking bag device of claim 3, wherein said neck is a threaded open neck and said removable cap is complementarily threaded to said neck.

7. The underwater striking bag device of claim 3, wherein said at least one handle is on said bottom section.

8. The underwater striking bag device of claim 3, wherein said at least one handle is on said upper section.

9. The underwater striking bag device of claim 3, wherein said at least one handle comprises: one handle on said upper section; and another handle on said bottom section.

10. The underwater striking bag device of claim 3, wherein said at least one handle comprises: a pair of handles on said upper section which are separated by said neck; and a handle on said bottom section.

11. The underwater striking bag device of claim 1, wherein said at least one handle is on said upper section.

12. The underwater striking bag device of claim 1, wherein said at least one handle comprises: a pair of handles on said upper section which are separated by said neck.

* * * * *